US009511587B2

(12) United States Patent
Cook et al.

(10) Patent No.: US 9,511,587 B2
(45) Date of Patent: Dec. 6, 2016

(54) RESISTOR

(75) Inventors: Galen P. Cook, Albany, OR (US); Bradley D. Chung, Corvalis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 175 days.

(21) Appl. No.: 14/345,659

(22) PCT Filed: Oct. 14, 2011

(86) PCT No.: PCT/US2011/056270

§ 371 (c)(1),
(2), (4) Date: Mar. 19, 2014

(87) PCT Pub. No.: WO2013/055349

PCT Pub. Date: Apr. 18, 2013

(65) Prior Publication Data

US 2014/0224786 A1 Aug. 14, 2014

(51) Int. Cl.

| | |
|---|---|
| ***H05B 3/02*** | (2006.01) |
| ***B41J 2/16*** | (2006.01) |
| ***B41J 2/14*** | (2006.01) |
| ***H05B 3/00*** | (2006.01) |
| *B41J 2/005* | (2006.01) |

(52) U.S. Cl.

CPC ..... *B41J 2/1626* (2013.01); *B41J 2/1412* (2013.01); *B41J 2/14129* (2013.01); *B41J 2/1603* (2013.01); *B41J 2/1628* (2013.01); *H05B 3/00* (2013.01); *B41J 2002/0055* (2013.01); *B41J 2002/14387* (2013.01); *H05B 2203/013* (2013.01); *H05B 2203/017* (2013.01)

(58) Field of Classification Search

CPC ..... B41J 2/1626; B41J 2/1412; B41J 2/14129; B41J 2/1603; B41J 2/1628; B41J 2002/0055; B41J 2002/14387; H05B 3/00; H05B 2203/013; H05B 2203/017

See application file for complete search history.

(56) References Cited

U.S. PATENT DOCUMENTS

| | | | |
|---|---|---|---|
| 6,290,336 | B1 | 9/2001 | Cleland |
| 6,315,384 | B1 | 11/2001 | Ramaswami et al. |
| 6,675,476 | B2 | 1/2004 | Hostetler |
| 2005/0116998 | A1 | 6/2005 | Harada |
| 2009/0273636 | A1 | 11/2009 | Silverbrook |

FOREIGN PATENT DOCUMENTS

| | | | |
|---|---|---|---|
| JP | S63-191644 A | | 8/1988 |
| JP | H06-320735 A | | 11/1994 |
| JP | H08-300660 A | | 11/1996 |
| JP | 10-071717 | * | 3/1998 |
| JP | 10071717 | | 3/1998 |
| KR | 0151098 | | 12/1998 |
| KR | 0151101 | | 12/1998 |
| KR | 10-0425328 | * | 3/2004 |
| KR | 0425328 | | 3/2004 |
| KR | 0501859 | | 7/2005 |
| KR | 20060087856 | | 8/2006 |
| WO | WO-9855318 A1 | | 12/1998 |

OTHER PUBLICATIONS

Askeland, R.A. et al., The Second-generation Thermal Inkjet Structure—Effects of Materials and Processes Changes, Aug. 1988, http://findarticles.com/p/articles/mi_m0HPJ/is_n4_v39/ai_6894309/.

* cited by examiner

*Primary Examiner* — Shawntina Fuqua
(74) *Attorney, Agent, or Firm* — Fabian VanCott

(57) ABSTRACT

A method and apparatus provide a resistor electrically connected to an electrically conductive trace.

20 Claims, 12 Drawing Sheets

RESISTOR

BACKGROUND

Resistors are utilized in thermal resistor fluid ejection assemblies or printheads to eject drops of fluid or ink. Electrical current is conducted to the transistors using electrically conductive lines or traces. The configuration of the resistors and the traces are sometimes formed using a single etching step. The resistors formed using a single etching step may have thinned traces, which sometimes melt when used in the high temperature firing of fluids. Dimensional control of such resistors may be difficult, potentially leading to topography driven defects or poor step coverage which may lead to printhead failures. Because a large share of the printhead's thermal budget is consumed to compensate for dimensional variations of the resistors, printing throughput may be reduced.

DETAILED DESCRIPTION OF THE EXAMPLES

Figure 1:
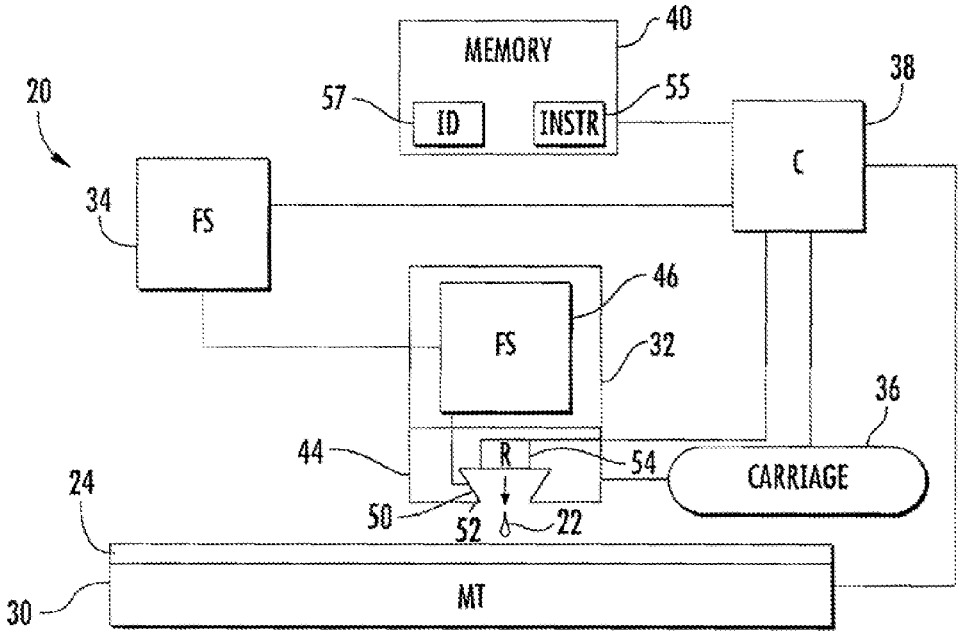
FIG. 1 is a schematic illustration of an example printing system.

FIG. 1 schematically illustrates an example printing system 20. Printing system 20 is configured to selectively deliver drops 22 of fluid or liquid onto a print media 24. Printing system 20 utilizes thermal drop-on-demand inkjet technology utilizing an array of resistor heating elements. As will be described hereafter, the array of resistor heating elements are provided as part of an architecture that facilitates fabrication using a method or process that achieves dimensional control and reduces topography driven defects.

Printing system 20 comprises media transport 30, printing unit 32, fluid supply 34, carriage 36, controller 38 and memory 40. Media transport 30 comprises a mechanism configured to transport or move print media 24 relative to print unit 32. In one example, print media 24 may comprise a web. In another example, print media 24 may comprise individual sheets. In one example to print media 24 may comprise a cellulose-based material, such as paper. In another example print media 24 may comprise other materials upon which ink or other liquids are deposited. In one example, media transport 30 may comprise a series of rollers and a platen configured to support media 24 as the liquid is deposited upon the print media 24. In another example, media transport 30 may comprise a drum upon which media 24 is supported as the liquid is deposited upon medium 24.

Print unit 32 ejects droplets 22 onto a media 24. Although one unit 32 is illustrated for ease of viewing, printing system 20 may include a multitude of print units 32. Each print unit 32 comprises printhead 44 and fluid supply 46. Printhead 44 comprises one or more chambers 50, one more nozzles 52 and one or more resistors 54. Each chamber 50 comprises a volume of fluid connected to supply 46 to receive fluid from supply 46. Each chamber 50 is located between and associated with one or more nozzles 52 and a resistor 54. Nozzles 52 each comprise small openings through which fluid or liquid is ejected onto print media 24.

Resistor 54 comprises an array of resistor heating elements positioned opposite to chamber 50. Each chamber 50 of printhead 44 has a dedicated resistor 54. Each resistor 54 is connected to electrodes provided by electrically conductive traces. The supply of electrical power to the electrically conductive traces and to each resistor 54 is controlled in response to control signals from controller 38. In one example, controller 38 actuates one or more switches, such as thin-film transistors, to control the transmission of electrical power across each resistor 54. The transmission of electrical power across resistor 54 heats resistor 54 to a sufficiently high temperature such that resistor 54 vaporizes fluid within chamber 50, creating a rapidly expanding vapor bubble that forces droplet 22 out of nozzle 52. As will be described hereafter, the architecture of resistor 54 facilitates fabrication using a method or process that achieves dimensional control and reduces topography driven defects for enhanced printhead reliability and throughput.

Fluid supply 46 comprises an on-board volume, container or reservoir containing fluid in close proximity with printhead 44. Fluid supply 34 comprises a remote or off axis volume, container or reservoir of fluid which is applied to fluid supply 46 through one or more fluid conduits. In some examples, fluid supply 34 may be omitted, wherein entire supply of liquid or fluid for printhead 44 is provided by fluid reservoir 46. For example, in some examples, print unit 32 may comprise a print cartridge which is replaceable or refillable when fluid from supply 46 has been exhausted.

Carriage 36 comprises a mechanism configured to linearly translate or scan print unit 32 relative to print medium 24 and media transport 30. In some examples where print unit 32 spans media transport 30 and media 24, carriage 36 may be omitted.

Controller 38 comprises one or more processing units configured to generate control signals directing the operation of media transport 30, fluid supply 34, carriage 36 and resistor 54 of printhead 44. For purposes of this application, the term "processing unit" shall mean a presently developed or future developed processing unit that executes sequences of instructions contained in memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other examples, hard wired circuitry may be used in place of or in combination with software instructions to implement the functions described. For example, controller 38 may be embodied as part of one or more application-specific integrated circuits (ASICs).

Unless otherwise specifically noted, the controller is not limited to any specific combination of hardware circuitry and software, nor to any particular source for the instructions executed by the processing unit.

In the example illustrated, controller 38 carries out or follows instructions 55 contained in memory 40. In operation, controller 38 generates control signals to fluid supply 34 to ensure that fluid supply 46 has sufficient fluid for printing. In those examples in which fluid supply 34 is omitted, such control steps are also omitted. To effectuate printing based upon image data 57 at least temporarily stored in memory 40, controller 38 generates control signals directing media transport 30 to position media 24 relative to print unit 32. Controller 38 also generates control signals causing carriage 36 to scan print unit 32 back and forth across print media 24. In those examples in which print unit 32 sufficiently spans media 24, control of carriage 36 by controller 38 may be omitted. To deposit fluid onto medium 24, controller 38 generates control signals selectively heating resistors 54 opposite to selected nozzles 52 to eject or fire liquid onto media 24 to form the image according to image data 57.

Figure 2:
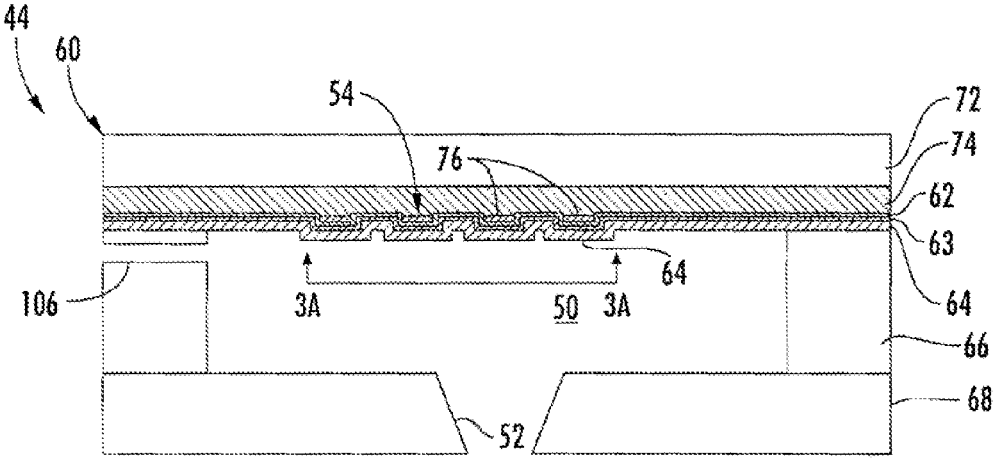
FIG. 2 is a sectional view of an example print head of the printing system of FIG. 1.
Figure 3B:
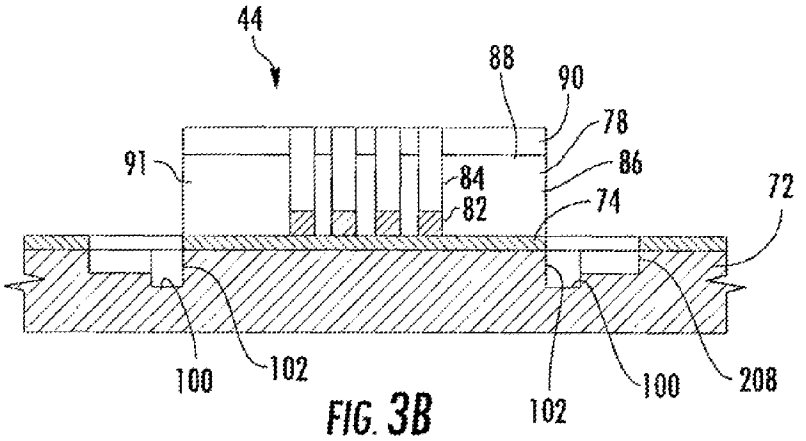
FIG. 3B is a sectional view of the print head taken along line 3B-3B of FIG. 3A.
Figure 3C:
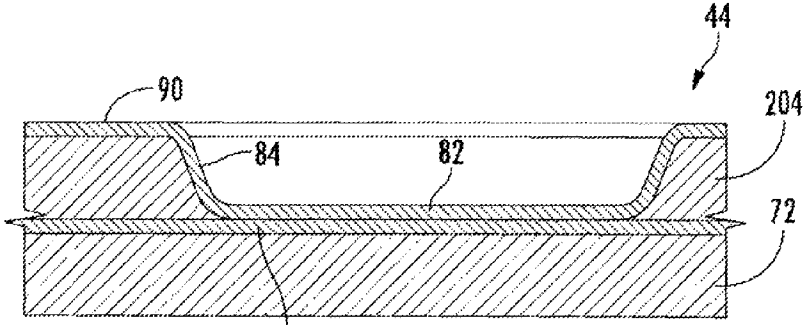
FIG. 3C is a sectional view of the print head taken along line 3C-3C of FIG. 3A.
Figure 3A:
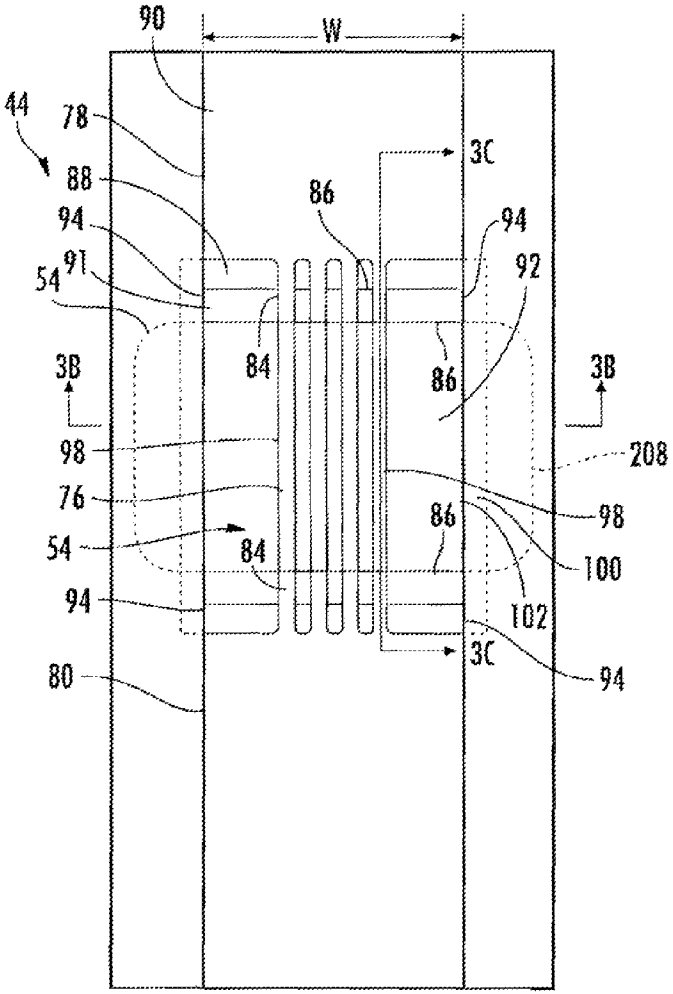
FIG. 3A is a plan view of the print head taken along line 3A-3A of FIG. 2.
Figure 4:
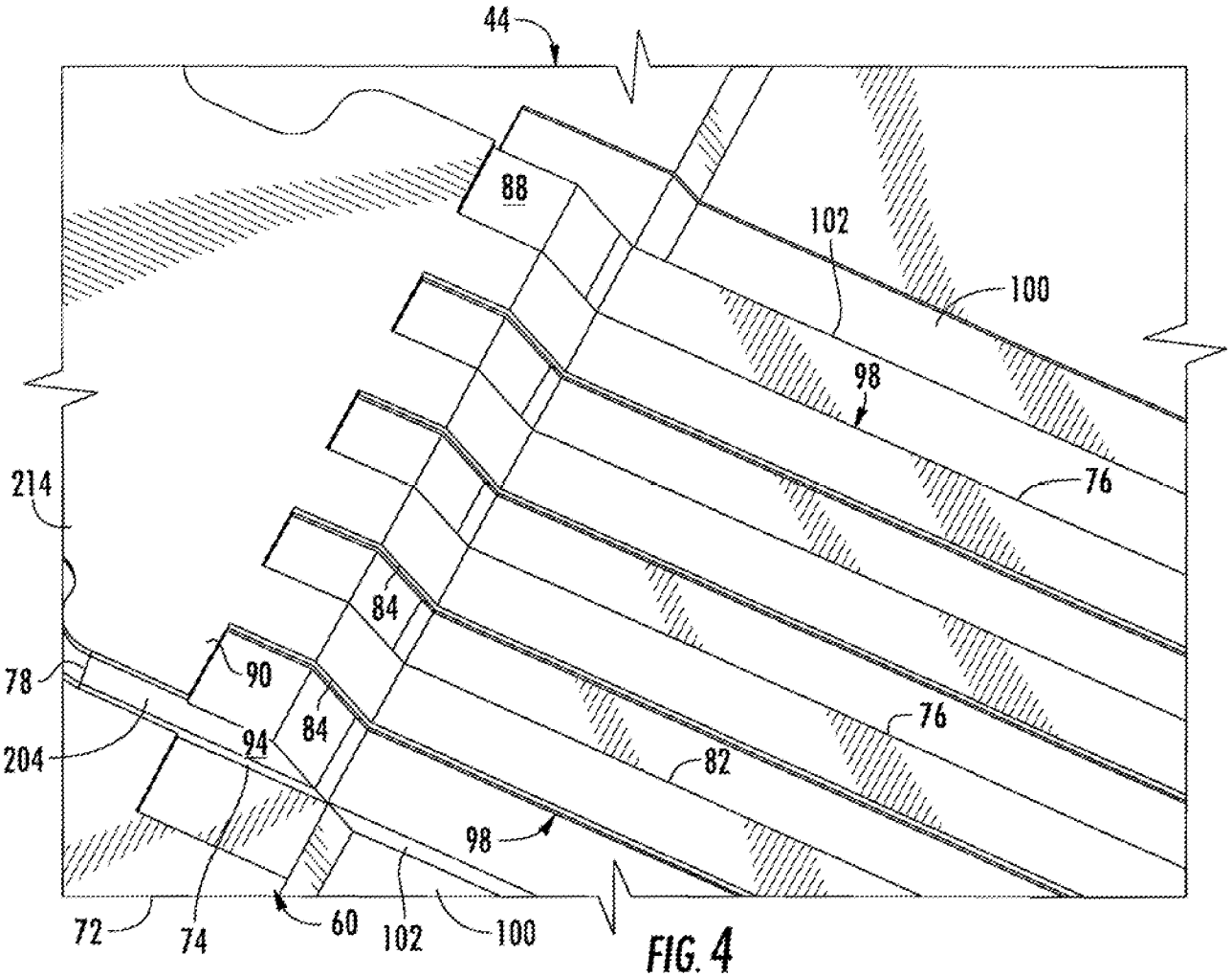
FIG. 4 is a fragmentary perspective view of an example resistor of the print head of FIG. 2.

FIGS. 2-4 illustrates one example of printhead 44 in more detail. As shown by FIG. 2, printhead 44 comprises substrate 60, resistor 54, passivation layers 62, 63, cavitation layer 64, barrier layer 66 and nozzle layer or nozzle plate 68 providing nozzle 50. In some examples, printhead 44 can contain only one nozzle with one resistor array. In other examples, printhead 44 can contain a plurality of nozzles with a plurality of resistors 54. Substrate 60 comprises one or more layers of electrically non-conductive materials supporting resistor 54. For purposes of this disclosure, the term "non-conductive" shall mean a material, not limited to, but typically having electrical conductivity of less than 10E−8σ (S/cm). In the example illustrated, substrate 60 comprises base layer 72 and passivation layer 74. Base layer 72 comprises a layer of electrically non-conductive material. In the example illustrated, base layer 72 comprises a layer of silicon. Passivation layer 74 comprises an oxide layer on top of base layer 72. In other examples, substrate 60 may include additional or fewer layers.

As shown by FIGS. 2-4, resistor 54 comprises an array of individual resistor heating elements 76. In the example illustrated, each resistor heating element 76 comprises an elongated strip or band of electrically resistive material extending from a first electrically conductive trace 78, across and in contact with substrate 60, to a second electrically conductive trace 80. For purposes of this disclosure, the term "electrically resistive" shall mean a material or structure having an electrical resistance, not limited to, but typically in the range of 60-2000 ohms such that electrical current is able to pass through the material or structure, but wherein the material or structure heats as a result of the electrical current flow. In the example illustrated, resistor heating elements 76 are formed from a layer of electrically resistive material such as WSiN. In other examples, elements 76 may be formed from other electrically resistive materials.

As shown by FIGS. 3A, 3B, 3C and 4, resistor heating elements 76 each have a resistive heating central portion 82 and a pair of opposite trace climbing connecting portions 84. Each resistive heating central portion 82 extends between traces 78, 80 directly on top of and in contact with a non-conductive surface provided by substrate 60. In the example illustrated, each resistive heating central portion 82 has a height or thickness, not limited to, but typically less than or equal to 5000 Å, between 200 Å and 2000 Å, and nominally 1000 Å. In the example illustrated, each resistive central portion 82 has a width, not limited to, but typically of less than or equal to 2 μm, between 0.5 μm and 1.5 μm, and nominally 1 μm. In the example illustrated, each resistive central portion 82 has a length, not limited to, but typically between about 10 μm and 60 μm, and nominally 30 μm.

Trace climbing portions 84 extend at opposite ends of central portions 82. Trace climbing portions 84 comprise those portions of the strips of electrically resistive material forming central heating portions 82 that extend from the uppermost surface of substrate 60 over the ends 86 of traces 78, 80 onto the top surface 88 of traces 78, 80. As best shown by FIG. 3, trace climbing portions 84 merge to a main layer 90 of the electrically resistive material which overlies top surface 88 of traces 78, 80.

In the example illustrated, resistor 54 includes an array of four parallel spaced heating elements 76. In other examples, resistor 54 may include a greater or fewer of such heating elements 76. In other examples, beating elements 76 of resistor 54 may not be parallel. Although each of heating elements 76 is illustrated as having substantially the same width and the same length, in other examples, heating elements 76 may have different widths or different lengths.

As further shown by FIGS. 3A-3C and 4, electrically conductive traces 78, 80 are spaced by an opening 92 extending between ends 86. Electrically conductive traces 78, 80 each have a width W at ends 86 between opposite side edges 94. At ends 86, electrically conductive traces 78, 80 continuously extend between side edges 94 while underlying trace climbing portions 84. As will be described hereafter, the process or method used to provide this architecture produces more reliable and uniform step coverage of trace climbing portions 84 over ends 86 of traces 78, 80.

Electrically conductive traces 78, 80 further underlie main layer 90 of the electrically resistive material. Although traces 78, 80 are illustrated as being substantially coextensive with main layer 90, in other examples, main layer 90 may terminate above traces 78, 80 or may be omitted.

In the example illustrated, electrically conductive traces 78, 80 are formed from a layer of electrically conductive material. For purposes of this disclosure, the term "electrically conductive" shall mean a material or structure having an electrical resistivity of less than or equal to 10E−3 Ω-cm. In one example, electrically conductive traces 78, 80 are formed from an electric conductive material such as AlCu. In other examples, electrically conductive traces 70, 80 may be formed from other electrically conductive materials.

In the example illustrated, electrically conductive traces 78, 80 have as height or thickness, not limited to, but typically between 0.1 μm and 1.5 um, and nominally 5000 Å. In other examples, traces 70, 80 may have other thicknesses.

As will be described in more detail hereafter, resistor 54 is formed with a first relatively short etch while traces 78, 80 are formed or defined with a second relatively longer etch. Because the etching of resistor 54 and the etching of traces 78, 80 are decoupled, the side walls of heating elements 76 of the resistor 54 have a relatively shallow thickness or height as compared to the thickness or height of traces 78, 80. Because traces 78, 80 have a width W defined by the second etch which is outside or beyond the outermost sides 98 of resistor 54, the second etch forms and etches recesses 100 within substrate 60 having edges 102 that are aligned with side edges 94 of traces 78, 80 and that are also spaced from the opposite edges 98 of resistor 54. As a result, the topography of heating elements 76 of resistor 54 is reduced (the height of heating elements 76 is reduced, by as much as five times in one example as compared to a single etch of both resistor 54 and traces 78, 80). This reduced topography or reduced variation in height improves the integrity and thickness uniformity of the protective layers or films 62,63 and cavitation layer 64 (shown in FIG. 2), over array 76 to enhance resistor life. Moreover, because the width W of traces 78, 80 is defined separately from the formation of heating elements 76, traces 78, 80 may be provided with a larger width W relative to the width of resistor 54, creating a localized heat sink to reduce the likelihood of traces 78, 80 melting during normal firing or even higher temperature firing, which could enable a range of firing performance benefits.

Because heating elements 76 are formed or defined in a shorter etch, rather than a much longer etch, which also must define traces 78, 80, dimensional variations of heating elements 76 that occur during etching are reduced, leading to more uniform widths and thicknesses of heating elements 76. As a result, less over energy may be budgeted to compensate for resistor width variations, increasing printer throughput.

Another benefit of etching heating elements 76 separate from traces 78, 80 is that the etching of 76 now only includes small features, rather than a mixture of large and small features. Mixing large and small etch features can result in etch rate differences (non-uniformity) that leads to added topography (some areas get over-etched while areas or features with slower etch rates are still under-etched).

Referring hack to FIG. 2, passivation layers 62 and 63 comprise a stack of thin films of materials covering heating elements 76, wherein the materials are chosen to protect heating elements 76 during other material removal processes and to electrically insulate or electrically isolate heating elements 76 from cavitation layer 64. In the example illustrated, layer 62 comprises a thin film layer of silicon nitride (SN) while layer 63 comprises a thin film layer of silicon carbonide (SC). In other examples, one or both of such layers may be omitted or may be provided by other materials.

Cavitation layer 64 comprises one or more layers of materials chosen so as to prevent substrate layer 60 or heating elements 76 from being fractured due to collapse of ink bubbles or the chemical attack of the ink, or fluid, itself. In one example, cavitation layer 64 comprises a layer of material such as tantalum. In other examples, cavitation layer 64 may be omitted or may have other configurations.

Barrier layer 66 comprises one or more layers of materials formed upon substrate 60 about resistor 54 so as space nozzle plate 68 from heating elements 66 to form chamber 50. Barrier layer 66 further provides a fluid inlet 106 through which fluid to be printer enters cavity or chamber 50 from fluid supply 46 (shown in FIG. 1).

Nozzle plate 68 comprises one or more layers, supported by barrier layer 66, which define openings or nozzles 52. In the example illustrated, nozzle plate 68 comprises a separate plate or structure joined to barrier layer 66. In other examples, nozzle plate 68 may be integrally formed as a single unitary body with barrier layer 66.

FIGS. 5-8 and 4 illustrate a process or method for forming resistor resistor 54 and traces 78, 80. As shown by FIGS. 5A and 5B, substrate 60, including base layer 72 and passivation/insulation layer 74 (such as an oxide like SiO2 or TEOS) is initially provided. In particular, passivation/insulation layer 74 is formed upon base layer 72. Thereafter, an electrically conductive layer 204 is formed upon or deposited upon substrate 60. Electrically conductive layer 204 is subsequently defined by etching to form traces 78, 80. As discussed above, electrically conductive layer 204 is formed from an electrically conductive material such as Al or AlCu. In the example illustrated, layer 204 has a thickness, not limited to, but typically between 0.1 μm and 1.5 um, and nominally 5000 Å.

Figure 6A:
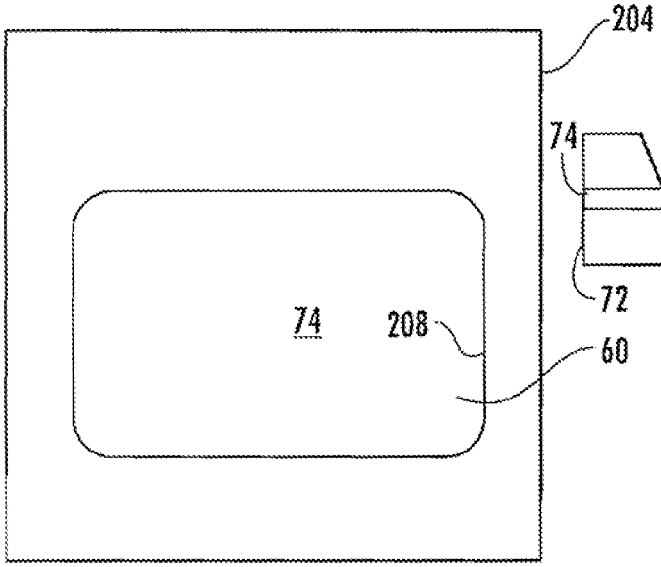
Figure 6B:
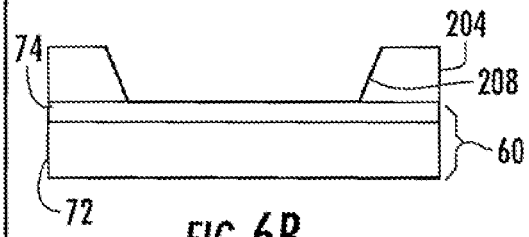

As shown by FIGS. 6A and 6B, an opening 208 is formed within layer 204. In the example illustrated, opening 208 extends through layer 204 to substrate 60. Opening 208 has dimensions sufficiently sized to accommodate the number of subsequently formed resistive heating elements 76. Although opening 208 is illustrated as comprising a window completely surrounded by outer portions of layer 204, in other examples, opening 208 may have open sides, completely separating opposite sides of layer 204. In one example, opening 208 is formed by etching. In other examples, opening 208 may be formed by other material removal techniques. In still other examples, opening 208 may be formed by selective material deposition techniques, wherein layer 204 is deposited upon substrate 60 except in those areas forming window 208.

Figure 7B:
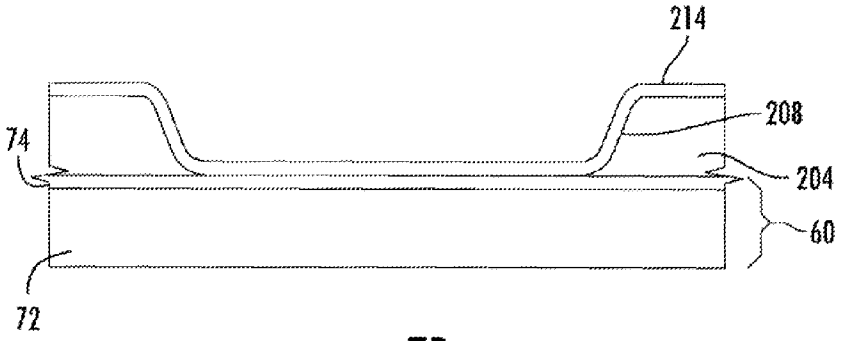
Figure 7A:
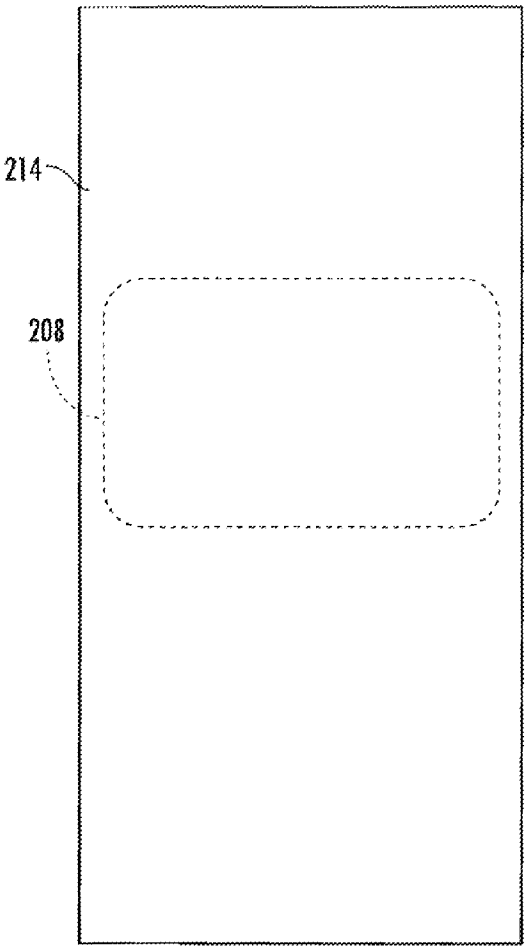

As shown by FIGS. 7A and 7B, after opening 208 has been formed, resistive material layer 214 is deposited or otherwise formed. Resistive material layer 214, from which resistor heating elements 76 of resistor 54 are separately formed, extends across opening 208, on and in contact with substrate 60, and up, over and onto electrically conductive layer 204. Resistive material layer 214 comprises one or more layers of electrically resistive material. In one example, resistive material 214 comprises WSiN. In the example illustrated, resistive material layer 214 has a thickness, not limited to, but typically less than or equal to 5000 Å, between 200 Å and 2000 Å, and nominally 1000 Å. In other examples, resistive material layer 214 may have other dimensions and may be formed from other electrically resistive materials.

Figure 8B:
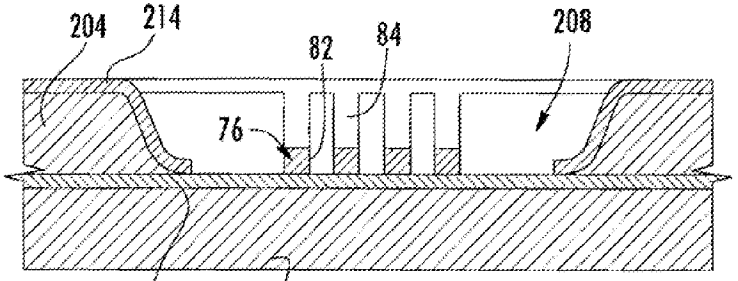
Figure 8C:
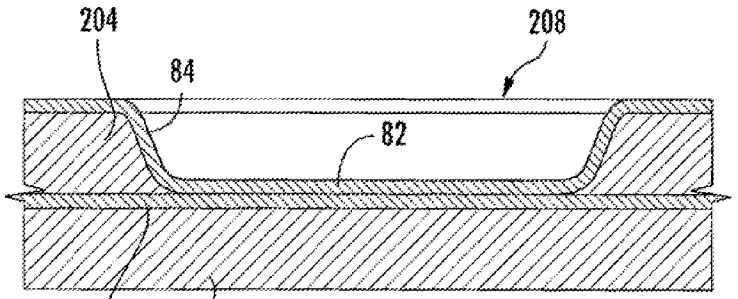
Figure 8A:
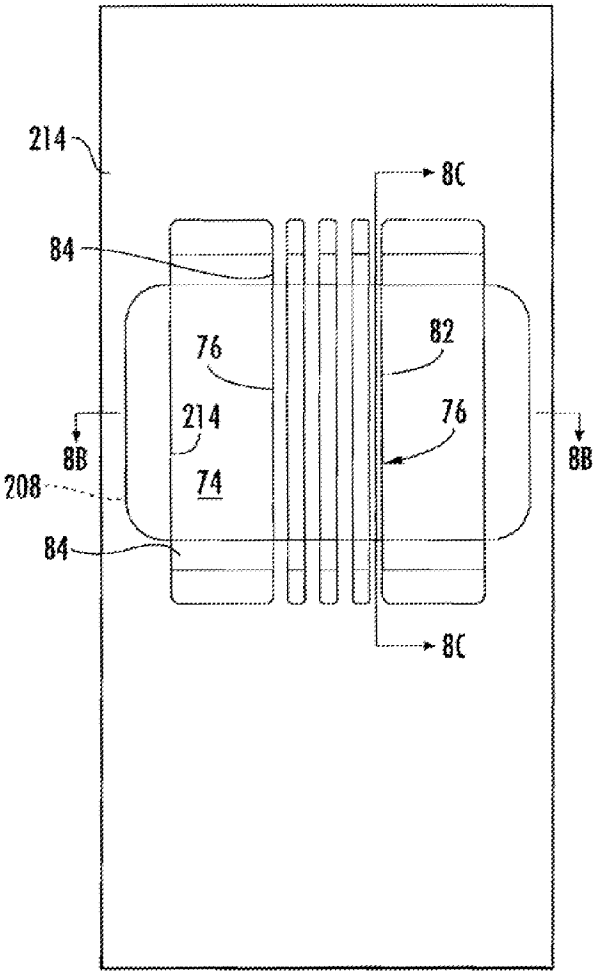

As shown by FIGS. 8A, 8B and 8C, an etching process is applied to the structure of FIG. 7 to define resistor heating elements 76 of resistor beating resistor 54. In particular, the relatively shallow etch (controlled based upon the intensity of the etch and duration of the etch) is performed to remove portions of electrically resistive layer 214, wherein the remaining portions of layer 214 form resistive heating elements 76, including portions 82, 84 and 90 (described above). The portions of layer 214 are selectively removed using masking or other etching area control techniques. Although main layer 90 is illustrated in FIG. 3A as extending over and above conductive traces 78, 80, in other examples, main layer 90 may be removed as part of the etching process.

According to one example, the etching of layer 214 to define resistor 54 is performed using a short, 30 second, plasma dry etch consisting mostly of chlorine based etch gases. In other examples, other material removal techniques are variations of the etching process described may be employed.

FIGS. 3A-3C and 4 illustrate the results of a subsequent etch which defines electrically conductive traces 78, 80. As noted above, the subsequent etching is distinct from the etching used to define or form resistor 54. As compared to the etching used to define resistor 54, the etching used to define traces 78, 80 is more aggressive, removing a greater amount of material due to the larger thickness of electrically conductive layer 204 as compared to resistive layer 214. As shown by FIG. 4, the trace defining etch removes any remaining portions of layer 214 and underlying portions of layer 204 outside of a designated width of traces 78, 80 to form side edges 94 of traces 78, 80. Because traces 78, 80 are defined in a separate etching processor step than the etching used to define resistive heating elements 76, side edges 94 of traces 78, 80 are spaced from edges 98 of resistor 54. Moreover, the side edges of the individual resistor heating elements 76 have a reduced topography (a reduced height above the adjacent portions of substrate 60 and the central portions 82 or above the underlying layer 214 in the trace climbing portions 84). As noted above, this reduced topography (shallower valleys and less pronounced peaks) across the beveled ends 91 of traces 78, 80, along edges 94 of resistor 54 and between the individual resistive heating elements 76 improves the integrity and thickness uniformity of the passivation layers 62, 63 and cavitation layer 64, over resistor 54 (shown in FIG. 2) to enhance resistor life.

Moreover, because the width W of traces 78, 80 (shown in FIG. 3A) are defined separately from the formation of heating elements 76, traces 78, 80 may be provided with a larger width W relative to the width of resistor 54, creating a localized heat sink to reduce the likelihood of traces 78, 80 melting during higher temperature firing, a condition that could enable a range of performance benefits, such as resistor surface cleanliness.

According to one example, the etching step used to define side edges 94 of traces 78, 80 is performed with a longer, 120 second, plasma dry etch consisting mostly of chlorine based etch gases. In other examples, other material, removal techniques are variations of the etching process described may be employed.

Figure 10:
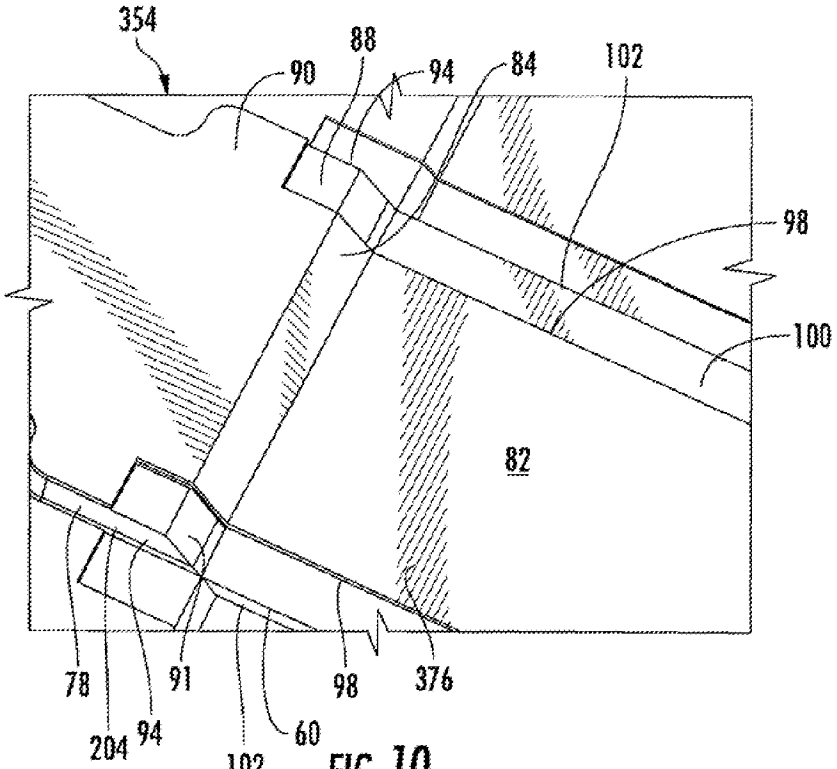
FIG. 10 is a fragmentary perspective view of the resistor of FIG. 9.
Figure 9:
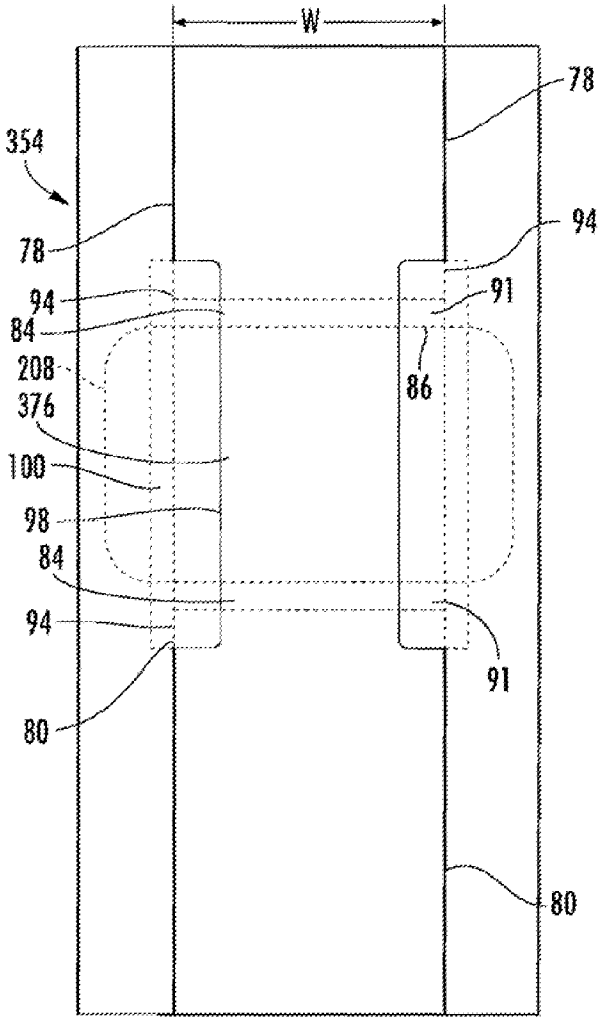
FIG. 9 is a bottom plan view of another example resistor of the print head of FIG. 2.

Although the process illustrated and described above depicts the formation of resistor 54 with an array of resistive heating elements 76, the same process may be utilized to form a resistor having a single rectangular resistive heating element 76. FIGS. 9 and 10 illustrate an example rectangular resistor 354 having a rectangular resistor heating element 376 that may be utilized in place of resistor resistor 54 shown in FIGS. 1 and 2. The process utilized to form resistor 354 is similar to the process used to form resistor 54 except that during the etch illustrated and described above with respect to FIGS. 8A-8C, a single rectangular resistive heating element 376 is defined rather than in array of resistive heating elements 76.

Figure 11:
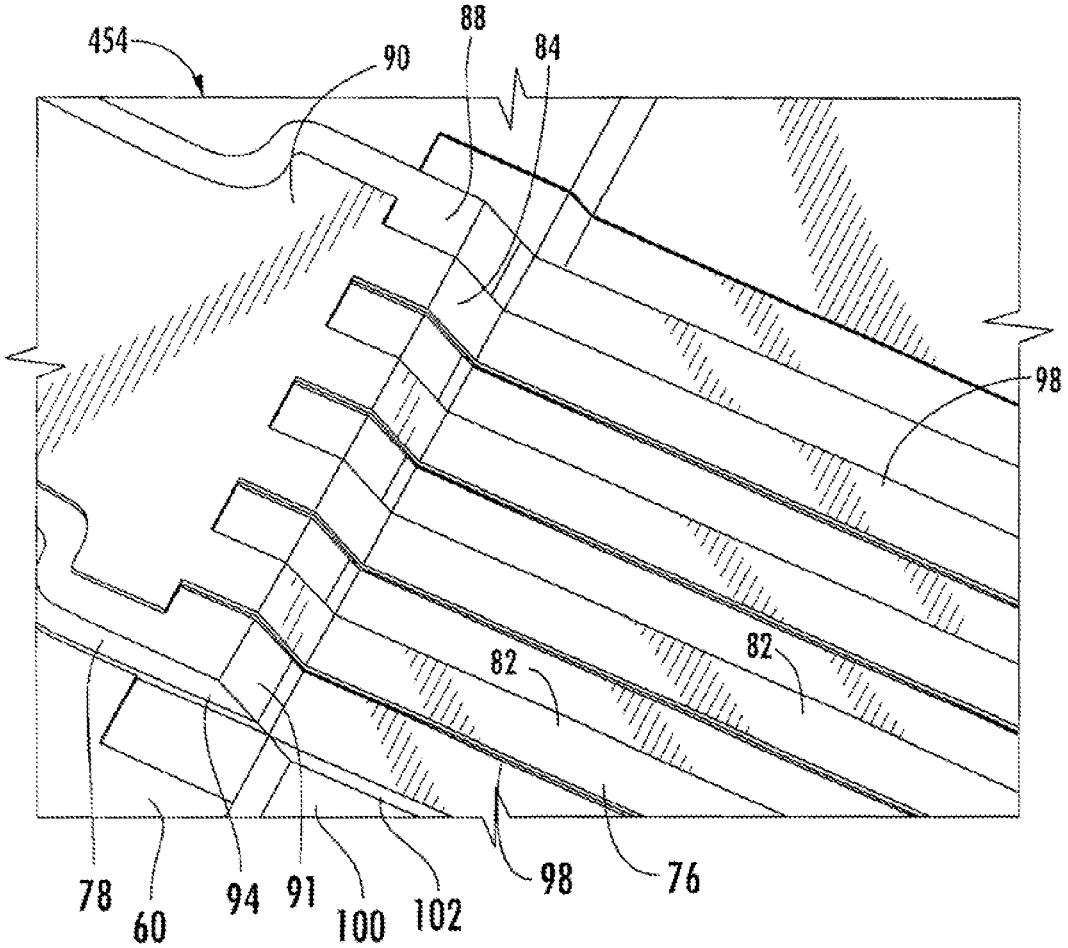
FIG. 11 is a fragmentary perspective view of another example resistor of the print head of FIG. 2.

FIG. 11 illustrates resistor array 454, another example of resistor 54 shown in FIGS. 1 and 2. Resistor array 454 is similar to resistor 54 except that resistor 454 is formed using the method or process shown in FIGS. 5A, 5B and 12-14. The process or method utilized to form resistor 454 is similar to the process or method utilized to form resistor 54 except that the etch used to define traces 78, 80 is performed before the etch used to define resistive heating elements 76.

Figure 5A:
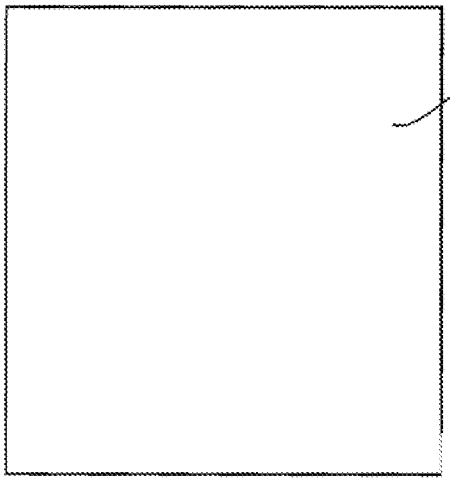
FIGS. 5-8C illustrate one example method of forming the resistors of FIG. 3.
Figure 5B:
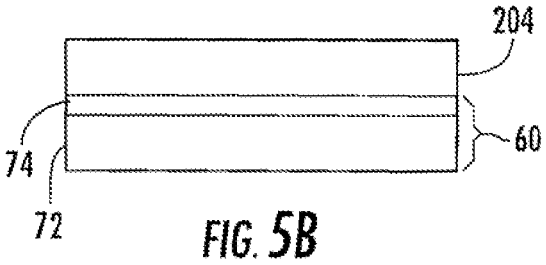

As shown in FIGS. 5A and 5B, as with the formation of resistor 54, substrate 60, including base layer 72 (shown in FIG. 5B) and passivation/insulation layer 74 (such as an oxide like SiO2 or TEOS) is initially provided. In particular, passivation/insulation layer 74 is formed upon base layer 72. Thereafter, an electrically conductive layer 204 is formed upon or deposited upon substrate 60. Electrically conductive layer 204 is subsequently defined by etching to form traces 78, 80. As discussed above, electrically conductive layer 204 is formed from an electrically conductive material such as Al or AlCu. In the example illustrated, layer 204 has a thickness, not limited to, but typically between 0.1 μm and 1.5 um, and nominally 5000 Å.

Figure 12:
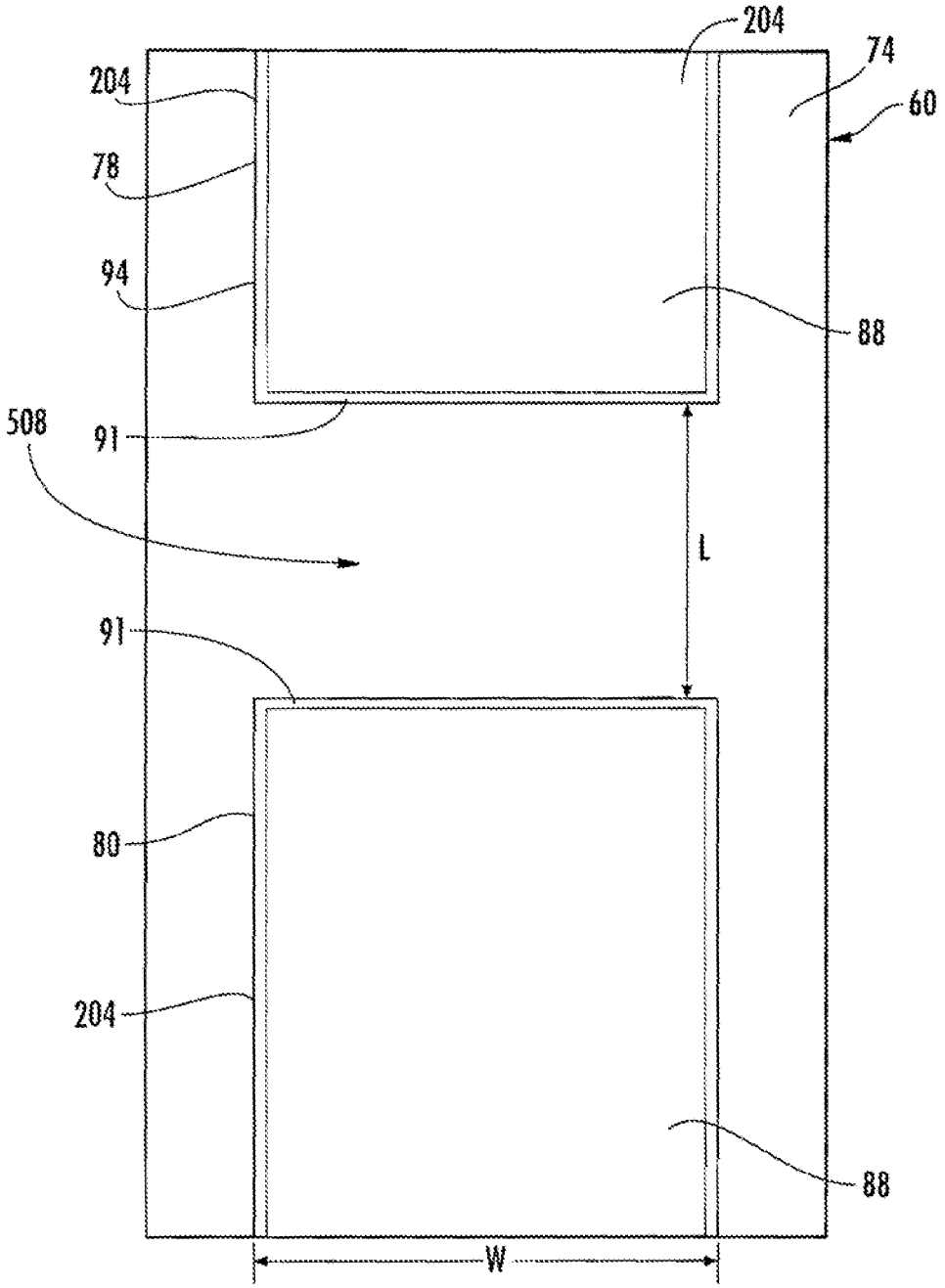
FIGS. 12-14 illustrates one example method performing the resistor of FIG. 11.

As shown by FIG. 12, an etching process is applied to electrically conductive layer 204 to define the width W of conductive traces 78, 80 and to also form an opening 508 which will be subsequently used to establish a length for resistive heating elements 76. According to one example, the etching step used to define side edges 94 of traces 78, 80 is performed with a longer, 120 second, plasma dry etch consisting mostly of chlorine based etch gases. In other examples, other material removal techniques or variations of the etching process described may be employed. As indicated by broken lines, the etch which defines the width W of traces 78, 80 forms a ramped or beveled portion and/or edge 91.

Figure 13:
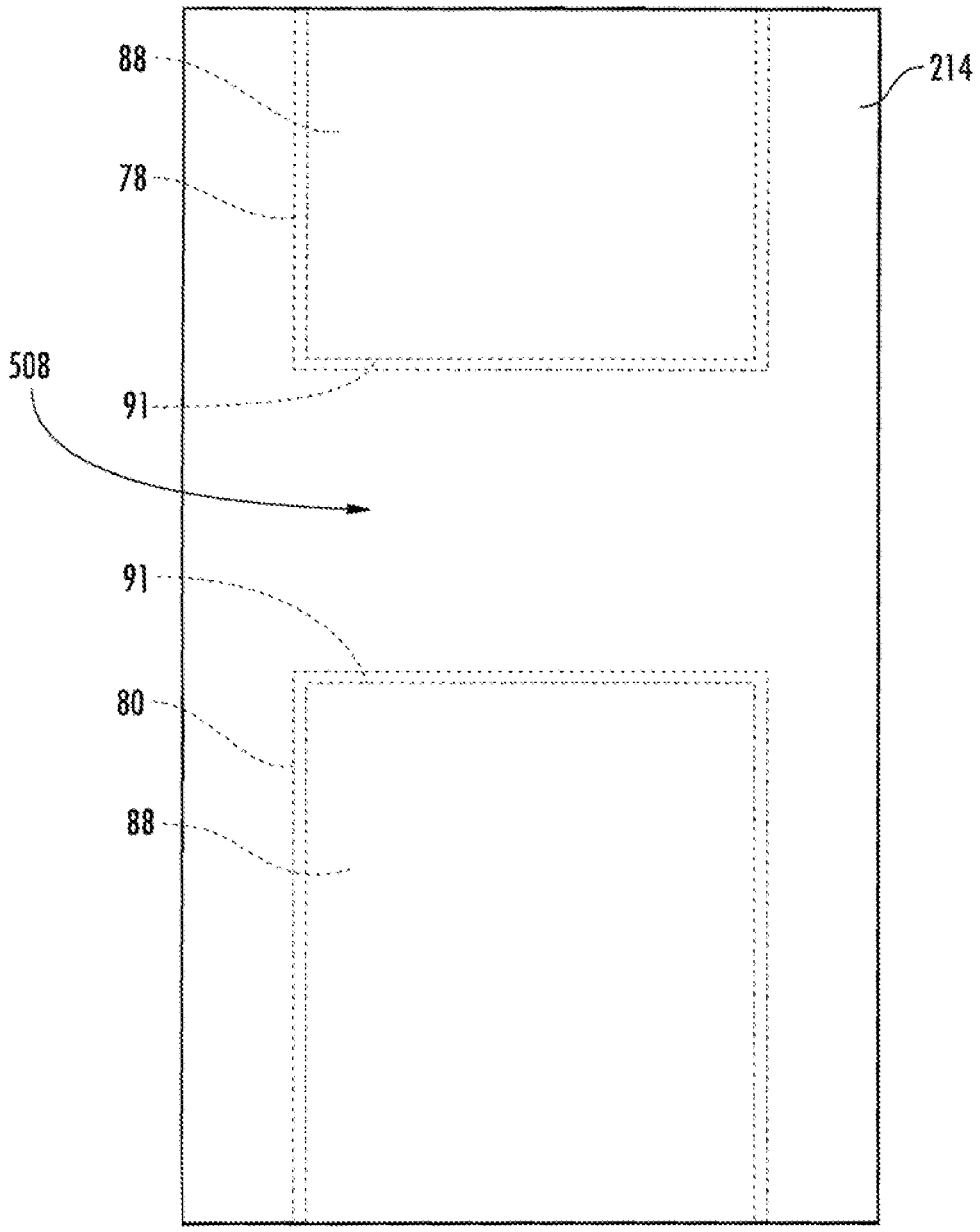

As shown by FIG. 13, similar to the step shown in FIGS. 7A and 7B, resistive material layer 214 is deposited or otherwise formed. Resistive material layer 214, from which resistor heating elements 76 of array 454 are separately formed, extends across opening 508, on and in contact with substrate 60, and up, over and onto electrically conductive layer 204. Resistive material layer 214 comprises one or more layers of electrically resistive material. In one example, resistive material 214 comprises WSiN. In the example illustrated, resistive material layer 214 has a thickness, not limited to, but typically less than or equal to 5000 Å, between 200 Å and 2000 Å, and nominally 1000 Å. In other examples, resistive material layer 214 may have other dimensions and may be formed from other electrically resistive materials.

Figure 14:
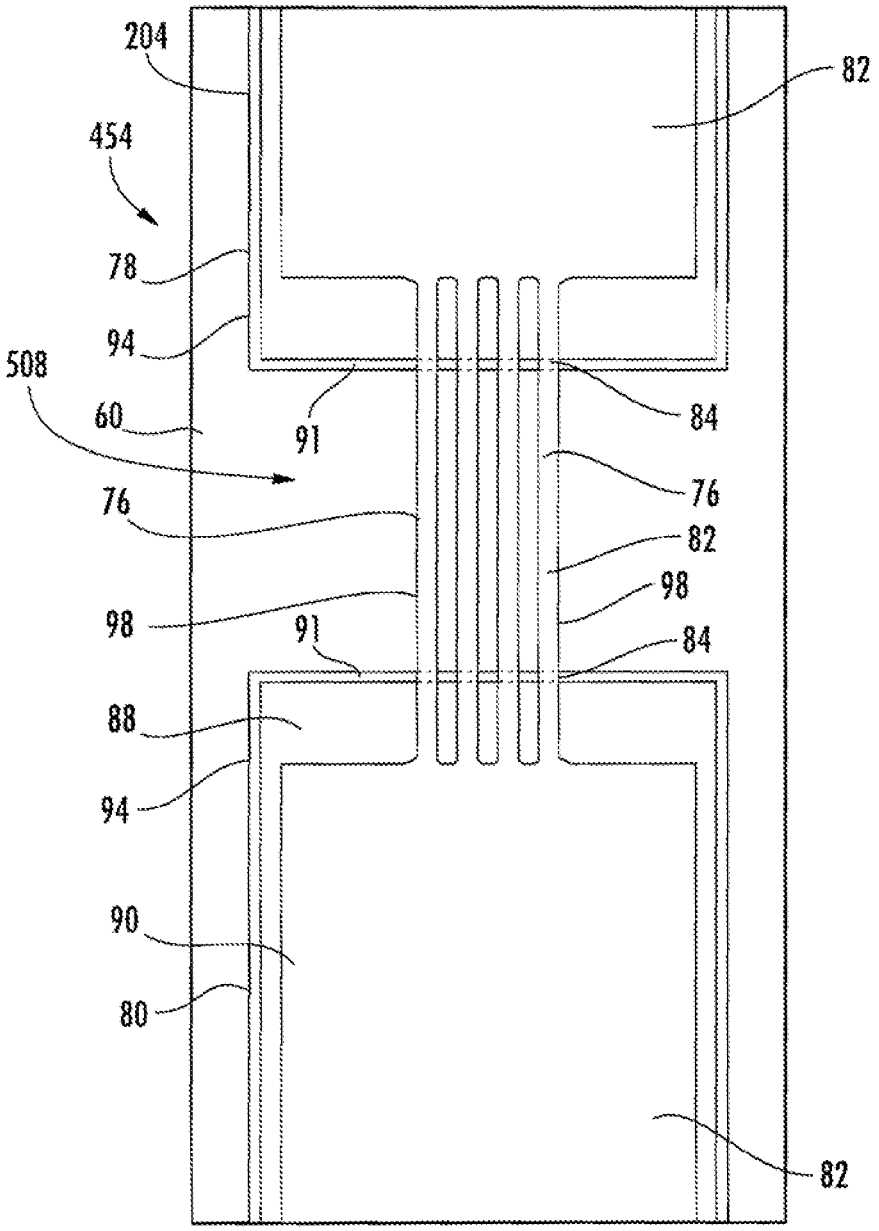

As shown by FIGS. 11 and 14, a second etching process is applied to define resistive heating elements 76 of resistor array 454. In particular, a relatively shallow etch (controlled based upon the intensity of the etch and duration of the etch) is performed to remove portions of electrically resistive layer 214, wherein the remaining portions of layer 214 form resistive heating elements 76, including portions 82, 84 and 90 (described above). The portions of layer 214 are selectively removed, using masking or other etching area control techniques. Although main layer 90 is illustrated as extending over and above conductive traces 78, 80, in other examples, main layer 90 may be removed as part of the etching process shown in FIG. 14.

According to one example, the etching of layer 214 to define resistive heating elements 76 of array 454 is performed using a short, 30 second, plasma dry etch consisting mostly of chlorine based etch gases. In other examples, other material removal techniques are variations of the etching process described may be employed.

The described process used to form resistor array 454 offers many of the same advantages discussed above with respect to the process used to form resistor 54. In particular, the process used to form resistor 454 also provides resistive heating elements 76 with a reduced height for central portions 82 above the adjacent portions of substrate 60 and a reduced height for trace climbing portions 84 across the beveled ends 91 of traces 78, 80 to provide a reduced topography (shallower valleys and less pronounced peaks) This reduced topography improves the integrity and thickness uniformity of passivation layers 62,63 and cavitation layer 64, over resistor 54 (shown in FIG. 2) to enhance resistor life. Because the width W of traces 78, 80 is defined separately from the formation of heating elements 76, traces 78, 80 may be provided with a larger width W relative to the width of resistor 54, creating a localized heat sink to reduce the likelihood of traces 78, 80 melting during higher temperature firing, a condition that could enable a range of performance benefits, such as resistor surface cleanliness. In addition, because heating elements 76 are formed or defined in a shorter etch, rather than the much longer etch which defines traces 78, 80, dimensional variations of heating elements 76 that occur during etching are reduced, leading to less variation in the widths and thicknesses of heating elements 76. As a result, less over energy may be budgeted to compensate for resistor with variations, increasing printer throughput.

While providing many of the same benefits as the process used to form resistor 54, the processes to form resistor array 454 offer additional advantages. For example, as compared to the process performing resistor 54, the process used to form resistor 454 omits a photo and etch process step. In particular, the formation of opening 508 is formed with the same etch shown in FIG. 12 that defines conductive traces 78, 80. Moreover, because the etching process shown in FIG. 12 occurs over a larger area (more exposed surface area of the material being removed results in a greater signal strength, which indicates when the material of interest has cleared) the etch can now be closely controlled by using an endpoint signal, a process control option available on dry etch tooling, thus dimensional control over length of opening 508 and over the subsequent length of resistive heating elements 76 is enhanced.

Figures 15, 16:
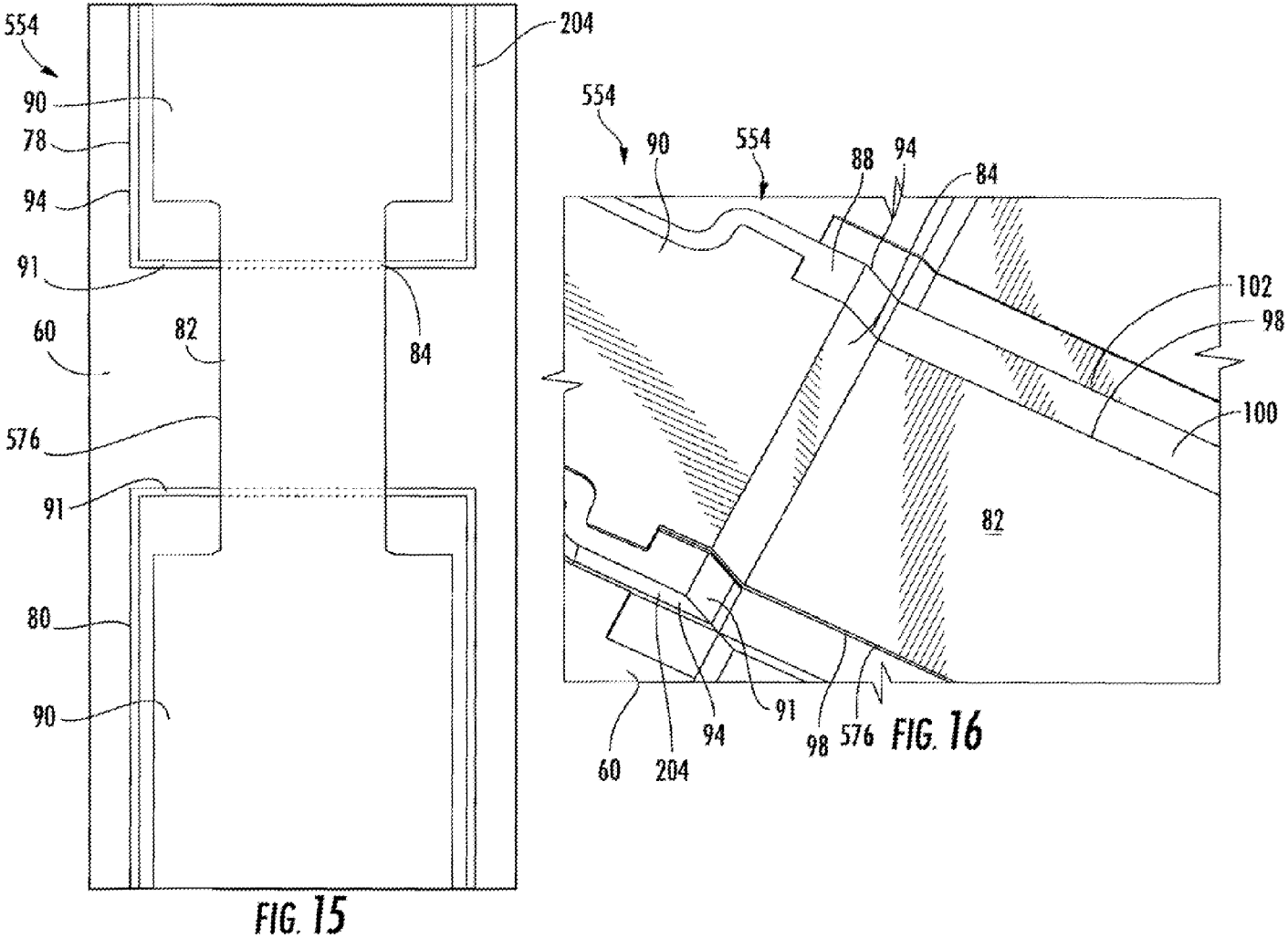
FIG. 15 is a bottom plan view of another example resistor of the print head of FIG. 2.
FIG. 16 is a fragmentary perspective view of the resistor of FIG. 15.

Although the process illustrated and described above depicts the formation of the array 454 of resistive heating elements 76, the same process may be utilized to form a single rectangular resistive heating element 576. FIGS. 15 and 16 illustrate an example rectangular resistor 554 having a rectangular resistor heating element 576 that may be utilized in place of resistor 54 shown in FIGS. 1 and 2. The process utilized to form resistor 554 is similar to the process used to form resistor 454 except that during the etch illustrated and described above with respect to FIG. 14, a single rectangular resistive heating element 576 is defined rather than in array of resistive heating elements 76.

Although the present disclosure has been described with reference to examples, workers skilled in the art will recognize that changes may be made in form and detail without departing from the spirit and scope of the claimed subject matter. For example, although different examples may have been described as including one or more features providing one or more benefits, it is contemplated that the described features may be interchanged with one another or alternatively be combined with one another in the described examples or in other alternative examples. Because the technology of the present disclosure is relatively complex, not all changes in the technology are foreseeable. The present disclosure described with reference to the examples and set forth in the following claims is manifestly intended to be as broad as possible. For example, unless specifically otherwise noted, the claims reciting a single particular element also encompass a plurality of such particular elements.

What is claimed is:

1. A method comprising:

performing a first etch upon a structure to form a resistor comprising an array of spaced resistor heating elements, the first etch forming gaps spacing the resistor heating elements from each other; and performing a second etch upon the structure to form an electrically conductive trace electrically connected to the resistor.

2. The method of claim 1, wherein the second etch is performed before the first etch.

3. The method of claim 1, wherein the first etch is performed before the second etch.

4. The method of claim 1, wherein the first etch has a first duration and wherein the second etch has a second duration greater than the first duration.

5. The method of claim 1, wherein the first etch removes portions of a resistive material layer overlying a conductive material layer without completely removing those portions of the conductive material layer that underlie removed portions of the resistive material layer and wherein the second etch removes portions of the conductive material layer to form the electrically conductive trace.

6. The method of claim 1, wherein the structure comprises:

a nonconductive substrate;

a conductive material layer on the substrate and having an opening to the substrate; and a resistive material layer of an electrically resistant material over the conductive material layer and in the opening upon the substrate; and wherein the array of resistor heating elements formed by the first etch continuously extend from within the opening on the substrate onto the conductive material layer outside the opening and wherein the gaps spacing the array of resistor heating elements overlie the conductive material layer which continuously extends across the gaps.

7. The method of claim 6 further comprising providing the structure, wherein providing the structure comprises:

etching the opening in the conductive material layer; and depositing the resistive material layer over the conductive material layer, across and in the opening.

8. The method of claim 7, wherein the second etch removes at least portions of the substrate to form a substrate edge spaced from each opposite edge of the array of resistor heating elements.

9. The method of claim 1 further comprising:

forming a chamber opposite the resistor;

forming a liquid flow passage to the chamber; and forming a nozzle opposite the resistor, wherein the chamber extends between the resistor and the nozzle.

10. A method comprising:

performing a first etch upon a structure to form a resistor comprising an array of spaced resistor heating elements; and performing a second etch upon the structure to form an electrically conductive trace electrically connected to the resistor, wherein the first etch removes portions of a resistive material layer overlying a conductive material layer without completely removing those portions of the conductive material layer that are in the gaps spacing the resistor heating elements and underlie removed portions of the resistive material layer and wherein the second etch removes portions of the conductive material layer to form the electrically conductive trace.

11. An apparatus comprising:

an electrically conductive material layer forming an electrically conductive trace terminating at an end and continuously extending between a first edge and a second edge opposite the first edge;

an electrically resistive material layer over and electrically connected to the electrically conductive material layer, the electrically resistive material layer forming a resistor having an array of spaced resistor heating elements overlying the electrically conductive material layer between the first edge and the second edge, the spaced resistor heating elements projecting beyond the end of the electrically conductive trace out of contact with the electrically conductive material layer.

12. The apparatus of claim 11, wherein the array of spaced resistor heating elements projecting beyond the end of the electrically conductive trace overlie a nonconductive substrate and wherein the nonconductive substrate has an edge aligned with an edge of the electrically conductive trace and spaced from each opposite edge of the array of resistor heating elements.

13. The apparatus of claim 11 further comprising:

a chamber opposite the array of resistor heating elements;

a liquid flow passage to the chamber; and a nozzle opposite the array of resistor heating elements, wherein chamber extends between the array of resistor heating elements and the nozzle.

14. The method of claim 2, wherein the second etch forms an opening in a conductive layer to receive the resistor and forms sidewalls of the electrically conductive trace outside of the opening, and wherein the method further comprises forming a resistive material layer upon the opening.

15. The method of claim 3, further comprising:

performing an initial etch before the first etch to form an opening in a conductive layer; and forming a resistive material layer upon the opening.

16. The method of claim 15, wherein the gaps extend beyond the opening and onto the conductive layer.

17. The method of claim 1, wherein the first etch is a shallow etch to produce resistor heating element side walls with a shallow thickness.

18. The method of claim 10, wherein the first etch produces resistor heating element side walls with a shallow thickness, and wherein the second etch produces electrically conductive trace side walls with a deep thickness.

19. The method of claim 10, wherein the electrically conductive trace continuously extends an entire width of the resistor.

20. The method of claim 19, wherein the electrically conductive trace continuously extends between a first edge and a second edge opposite the first edge, wherein the array of spaced resistor heating elements overlies the electrically conductive trace between the first edge and the second edge, and wherein the array of spaced resistor heating elements projects beyond an end of the electrically conductive trace out of contact with the electrically conductive material layer.

* * * * *